United States Patent [19]

Kröening

[11] Patent Number: 5,049,783

[45] Date of Patent: Sep. 17, 1991

[54] ELECTRONIC BALLAST DEVICE FOR FLUORESCENT LAMPS

[75] Inventor: Armin Kröening, Nussdorf, Fed. Rep. of Germany

[73] Assignee: Siemens Aktiengesellschaft, Munich, Fed. Rep. of Germany

[21] Appl. No.: 604,811

[22] Filed: Oct. 29, 1990

[30] Foreign Application Priority Data

Dec. 1, 1989 [EP] European Pat. Off. ..... 89122189.7

[51] Int. Cl.[5] ..... H05B 41/26

[52] U.S. Cl. ..... 315/102; 315/96; 315/219; 315/228; 315/DIG. 5

[58] Field of Search ..... 315/95, 96, 102, 103, 315/104, 209 R, 219, 220, 226, 228, 239, 324, DIG. 5

[56] References Cited

U.S. PATENT DOCUMENTS 3,710,177 1/1973 Ward ..... 315/106
4,730,147 3/1988 Kroening ..... 315/104 X

FOREIGN PATENT DOCUMENTS 0178852 4/1986 European Pat. Off. .
1190570 4/1965 Fed. Rep. of Germany .
3607109 5/1987 Fed. Rep. of Germany .
2212995 8/1989 United Kingdom .

*Primary Examiner*—David Mis
*Attorney, Agent, or Firm*—Hill, Van Santen, Steadman & Simpson

[57] ABSTRACT

In an electronic ballast for at least one fluorescent lamp equipped with heatable electrodes, the heatable electrodes must be adequately preheated before the actual ignition of the fluorescent lamp. Given a high-frequency preheating of the heating electrodes that is usually employed and given the utilization of a frequency shift of the high-frequency of the D.C.-A.C. converter, relatively long preheating times on the order of magnitude of >1.2 second result. In order to be able to significantly reduce the preheating tifme below 1 second, it is proposed that a D.C. path be provided wherein the heating electrtodes are connected in series with the secondary winding at the secondary side of a transformer and to connect this D.C. path to the operating D.C. voltage during the preheating phase via controlled switches.

7 Claims, 1 Drawing Sheet

FIG2

RECTIFIER
OW
HARMONIC FILTER
Un
GL
RELAY
A
Cb
Ub
PREHEAT CONTROL (TIMER)
VH
STARTER CIRCUIT
ST
INHIBITING CIRCUIT (TIMER)
SS
SWITCH
S1
S2
Wz
SU
WR
D1
D2
P
DC-AC CONVERTER
Ck
iVH
RV
SWITCH
S11
a1
LK
C1
C2
Cn
LL1
LL2
LL3
He
TR1
TR2
TRn
FLUORESCENT LAMP
a2
SWITCH
S12

Ub
VH
SS
ST
iVH
t1
t2
t3

ELECTRONIC BALLAST DEVICE FOR FLUORESCENT LAMPS

BACKGROUND OF THE INVENTION

1. Field of the Invention

The present invention relates to an electronic ballast device for at least one fluorescent lamp equipped with heatable electrodes, the device comprising a D.C.-A.C. converter having an input for receiving an operating D.C. voltage and an A.C. output and a D.C. output connected to a load which comprises a fluorescent lamp, the lamp heater electrodes, and a transformer for the potential-free connection of the fluorescent lamp to the output of the D.C.-A.C. converter.

2. Description of the Prior Art

Given a turn-on event with a fluorescent lamp equipped with heatable electrodes, the electrodes constructed as heating coils and referred to below in brief as heating or heater electrodes, must first be adequately preheated in order to be able to subsequently ignite the fluorescent lamp reliably and free of flickering effects.

For example, U.S. Pat. No. 3,710,177, fully incorporated herein by this reference, produces a high-frequency heating of the heating electrodes with the assistance of a frequency shift of the switching frequency of the D.C.-A.C. converter. The task of the frequency shift is, first of all, to assure a rapid preheating and, secondly, to prevent the fluorescent lamp from receiving a high voltage during the preheating interval that would prematurely effect its ignition.

As warranted, the voltage at the fluorescent lamp can also be lowered during the preheating interval simultaneously with the frequency shift.

Since the high-frequency performance of the D.C.-A.C. converter is limited, the preheating time cannot be kept arbitrarily short. As a rule, preheating times on the order of magnitude of more than 1.2 seconds thereby result. In other words, the turn-on of the fluorescent lamp is delayed by the preheating time over a time interval that definitely proves disturbing.

SUMMARY OF THE INVENTION

For an electronic ballast device of the type initially set forth, the object of the present invention is to provide a further solution by which preheating times significantly shorter than 1 second can be achieved, and in particular with a relatively low technological expense.

The above object is achieved, according to the present invention, in an electronic ballast device for at least one fluorescent lamp equipped with heatable electrodes, comprising a D.C.-A.C. converter whose input side is supplied with an operating D.C. voltage and whose output side is connected in communication with a load circuit comprising a fluorescent lamp that cocomprises a transformer for the potential-free connection of the fluorescent lamp to the output of the D.C.-A.C. converter, and which is particularly characterized in that, at the side of the load circuit, the secondary winding of the transformer is connected in series with the heating electrodes of the fluorescent lamp forms a D.C. current path for the preheating current that is connectible during a turn-on event to an operating D.C. voltage provided from the D.C.-A.C. converter for a prescribed preheating interval, potentially in series with a preheating resistor, and being connectible thereto via switches actuated by a preheating control.

The present invention is based on the perception that the preheating of the heating electrodes of the fluorescent lamp can occur significantly faster abandoning a design of the ballast device for a higher electrical power when the electrical power required for this purpose is provided by the rectified line A.C. voltage. An arbitrarily-high preheating current for the heating electrodes can be made practically available in this manner. Thanks to the fluorescent lamp driven by the D.C.-A.C. converter via a transformer, the separation of potential thereby established allows a D.C. current path composed of the series circuit of the secondary winding of the transformer and the heating electrodes to be formed, this, given a turn-on event, being then connected to the operating D.C. voltage via switches for implementing the desired preheating and being, in turn, disconnected therefrom at the end of the preheating interval.

This type of D.C. preheating can also be applied in an extremely advantageous manner to ballast devices that must simultaneously supply two or more fluorescent lamps. The only requirement for this purpose is to connect the secondary windings of the transformers assigned to the individual fluorescent lamps and their heater electrodes in series in a suitable manner.

According to a particular feature of the invention, the electronic ballast device as set forth above is further particularly characterized in that two or more transformers have their primary sides connected in parallel to the output of the D.C.-A.C. converter with respect to alternating current, each transformer has its secondary side connected in communication with a fluorescent lamp, and the secondary windings of all transformers are connected in series such that all heating electrodes of the fluorescent lamps in series with a secondary windings of the transformers form a D.C. path for the preheating current.

According to another feature of the invention, the electronic ballast device, as described above, is characterized in that the switches are operating contacts of a relay whose excitation winding is connectible to the operating D.C. voltage via the preheating control.

According to another feature of the invention, the electronic ballast device, as described above, and further wherein the D.C.-A.C. converter is a self-controlled bridge switching arrangement having a saturation transformer that realizes a feedback of the output circuit onto the control inputs of the bridge switches, and is further characterized in that the saturation transformer comprises an auxiliary secondary winding that, given a turn-on event is short-circuited by an inhibiting circuit during the closing time of switches in the D.C. path for the preheating current, and in that, after the cancellation of the short-circuit of the auxiliary secondary winding, the inhibiting circuit activates a starter circuit that outputs a start pulse to the D.C.-A.C. converter, the start pulse triggering the defined response of the A.C.-D.C. converter.

According to another feature of the invention, an electronic ballast device, as specifically set forth above including the self-controlled bridge switching arrangement in the D.C.-A.C. converter, the saturation transformer, the inhibiting circuit and the starter circuit, the electronic ballast device is particularly characterized in that the inhibiting circuit that short-circuits the auxiliary secondary winding of the saturation transformer during a turn-on event does not eliminate the short-circuit situation until the switches have faultlessly interrupted the connection between the operating D.C. voltage and the D.C. path for the preheating current.

According to another feature of the invention, the electronic ballast device, as described above, is particularly characterized in that each of the load transformer is a stray field transformer whose stray field inductance, in common with the ignition capacitor is connected parallel to the fluorescent lamp forms a series resonant circuit that promotes the ignition event of the fluorescent lamp or lamps and that is approximately tuned to the switching frequency of the D.C.-A.C. converter.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figures 1, 2:
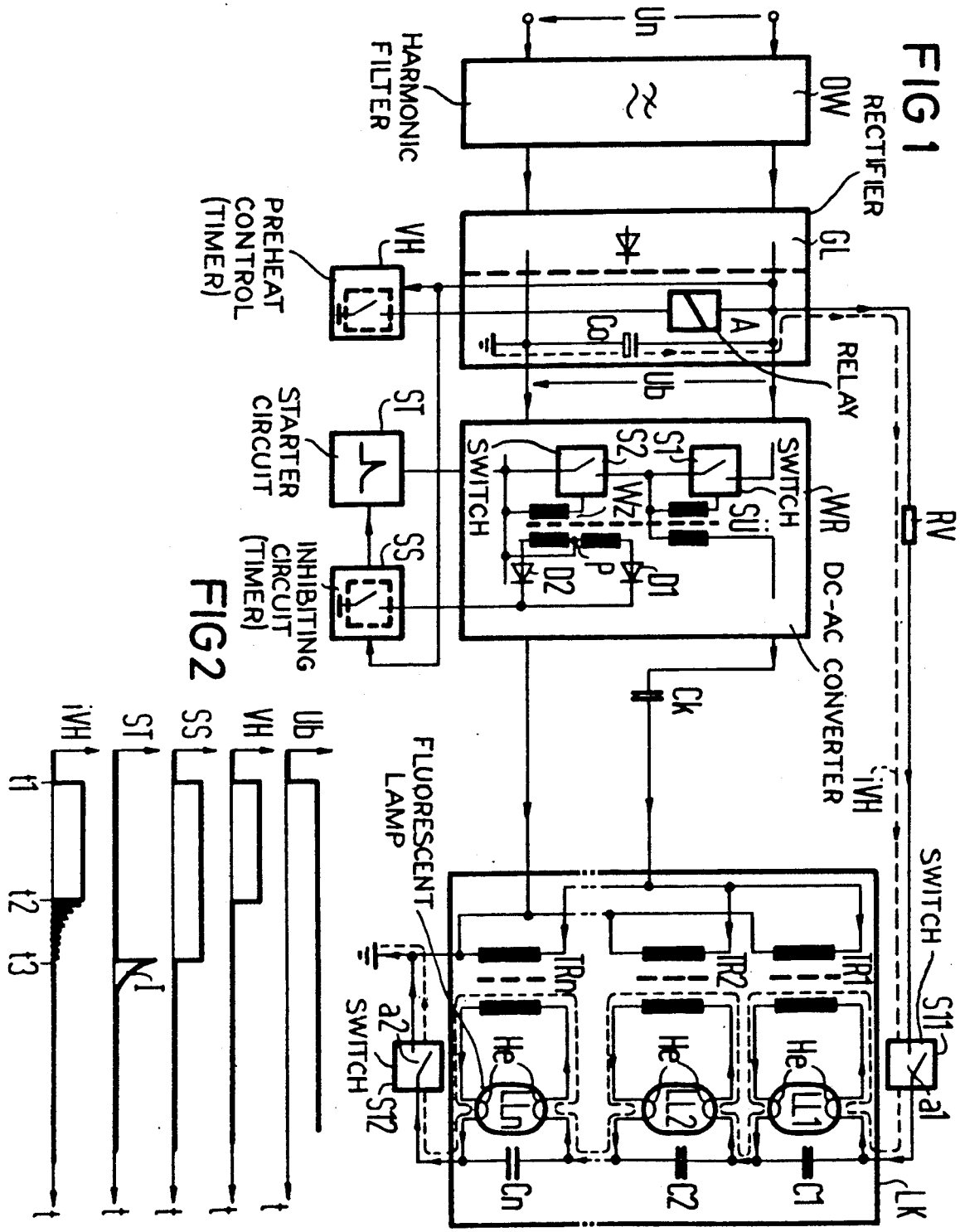
FIG. 1 is a block circuit and schematic circuit diagram of a ballast device provided for a plurality of fluorescent lamps and having a D.C. preheating time as provided by the present invention.
FIG. 2 is a timing diagram including a plurality of curves for aiding and explaining the operation of this circuit of FIG. 1.

Referring to FIG. 1, the best mode for practicing the present invention is generally illustrated in a block circuit diagram and schematic diagram form showing a ballast device allocated to a plurality of fluorescent lamps and comprising a harmonic filter OW including an input for connection to the line AC voltage Un. The harmonic filter OW is followed by a rectifier GL with a charging capacitor Co connected in parallel at the output side. The rectified, smoothed line AC voltage Un is applied to the charging capacitor Co in the form of the operating D.C. voltage Ub. The operating D.C. voltage supplied to the input side of the D.C.-A.C. converter WR is switched in the rhythm of a high frequency with the assistance of a self-controlled bridge switching arrangement and is supplied to a load circuit LK at its output side via a coupling capacitor Ck.

The load circuit LK comprises n fluorescent lamps LL1, LL2, . . . LLn to which, on the one hand, a respective ignition capacitor C1, C2, . . . Cn is connected in parallel and, on the other hand, the secondary winding of a transformer TR1, TR2, . . . TRn is connected in parallel. With respect to their primary windings, the transformers TR1, TR2, . . . TRn respectively assign to the fluorescent lamps LL1, LL2, . . . LLn are connected to the output of the D.C.-A.C. converter WR in parallel.

At the side of the ignition capacitors C1, C2, . . . Cn, the secondary windings of the transformers TR1, TR2, . . . TRn are connected in series with one another such that a D.C. path is thereby formed in which the heating electrodes He of all of the fluorescent lamps LL1, LL2, . . . LLn are connected in series with the secondary windings of the transformers TR1, TR2, . . . TRn. The common junction of the heating electrode He of the lamp LL1 with the ignition capacitor C1 is connected to the positive pole of the operating D.C. voltage Ub via a switch S11 and a heater dropping resistor RV. The negative pole of the operating D.C. voltage Ub lies at a reference potential, here ground. The D.C. path is connected to the reference potential at the common junction of the ignition capacitor Cn with the lower heating electrode He of the fluorescent lamp LLn, being likewise connected thereto via a switch S12. The switches S11 and S12 represent operating contacts a1 and a2 of a relay A whose excitation winding can be connected in parallel to the operating D.C. voltage Ub via a preheating control VH.

The preheating control VH is a timer switch that, when the ballast device is turned on, is activated by the operating D.C. voltage Ub being built up at the charging capacitor Co and that therefore causes the relay A to respond. The operating contacts a1 and a2 of the switches S11 and S12 that thereby close and connect the described D.C. current path via the heater dropping resistor RV and the operating D.C. voltage Ub and the preheating current IVH therefore flows via this D.C. current path and, therefore, across all of the heating electrodes He of the fluorescent lamps LL1, LL2, . . . LLn. In accordance with the setting of the timer of the preheating control VH, the preheating current iVH is again interrupted after a prescribed, short time interval via the relay A that deenergizes and the fluorescent lamps LL1, LL2, . . . LLn can then be ignited. The ignition occurs follows the deactivation of the preheating control VH due to the response of the self-controlled bridge switching arrangement whose bridge switches S1 and S2 are closed in alternation in the rhythm of the high-frequency switching frequency.

For the self-excitation operation, the self-controlled bridge switching arrangement comprises a saturation transformer SU with whose assistance the positive feedback of the output circuit of the D.C.-A.C. converter onto the control inputs of the bridge switches S11 and S12 is realized. As the D.C.-A.C. converter WR shown generally as a block illustrates therein, the saturation transformer SU comprises an auxiliary secondary winding Wz having a center tap P to which two diodes D1 and D2 are connected in series in opposite-poled directions. Using an inhibiting circuit SS, the common junction of the two diodes D1 and D2 can likewise be connected to a reference potential via a timer switch element and the auxiliary secondary winding Wz can therefore be short-circuited. Just like the preheating control VH, the inhibiting circuit SS responds given a turn-on of the ballast device and therefore prevents a parasitic response of the self-controlled bridge switching arrangement during the preheating phase.

As in the case of the preheating control VH, the activation of the inhibiting circuit SS occurs on the basis of the operating D.C. voltage Ub being built up at the charging capacitor Co given a turn-on event. The inhibiting circuit SS comprises another control output by way of which, after the elimination of the short-circuit condition of the auxiliary secondary winding Wz of the saturation transformer SU, a starter circuit ST (pulse generator) is activated for a defined response of the self-controlled bridge switching arrangement.

In order for an adequate ignition voltage to be respectively made available to the lighting fluorescent lamps LL1, LL2, . . . LLn of the load circuit LK, given the response of the D.C.-A.C. converter, the transformers TR1, TR2, . . . TRn are constructed as stray field transformers whose leakage inductances (not shown in FIG. 1) form series resonant circuits with the ignition capacitors C1, C2, . . . Cn, these series resonant circuits being approximately tuned to the high-frequency switching frequency of the D.C.-A.C. converter.

Insofar as it relates to the preheating of the heating electrodes of the fluorescent lamps LL1, LL2, . . . LLn with the heating current iVH, the timing diagram of FIG. 2 illustrate the sequence of a turn-on event over the preheating time interval. From top to bottom, the timing diagrams represent the curves of the operating D.C. voltage Ub, the switching behavior of the preheating control VH, the switching behavior of the inhibiting circuit SS, the chronological curve of the start pulse I output by the starter circuit ST and the curve of the preheating current iVH with respect to time t.

The preheating control VH and the inhibiting circuit SS are simultaneously activated with the turn-on of the ballast device and, therefore, with the appearance of the operating D.C. voltage Ub at the charging capacitor Co at a time t1. The inhibiting circuit SS still remains activated at a time t2 in the turn-off operation in the time of the preheating control VH, namely until a time t3 at which the unavoidable chattering of the operating contact a1 and a2, given deenergization of the relay A, have decayed. This chattering behavior of the operating contacts a1 and a2 is shown in the current diagram for the preheating current iVH. At the time t3, at which the preheating current iVH has completely decayed after being shut off at the time t2, the inhibiting circuit SS also switches off and therefore releases the D.C.-A.C. converter WR. Upon turn-off, the inhibiting circuit SS generates a control pulse for the starter circuit ST that thus outputs the start pulse I to the D.C.-A.C. converter WR.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Electronic ballast apparatus for operating at least one fluorescent lamp which includes heater electrodes, said apparatus comprising:

at least one load transformer including a primary winding, and a secondary winding connected to the heater electrodes;

a D.C.-A.C. converter including an input for receiving a D.C. voltage, a control input, and an output and operable to provide a high-frequency A.C. voltage at said output in response to a D.C. voltage at said input and the application of a start pulse at said control input;

input means including an input for connection to an A.C. voltage line, an output connected to said input of said D.C.-A.C. converter, and rectifier means connected between said input and said output for providing the D.C. voltage to said D.C.-A.C. converter;

a preheating resistor connected to said output of said input means; and switch means connected to said output of said input means and operable in response to the D.C. operating voltage to connect said preheating resistor, said secondary winding of said at least one load transformer and said heater electrodes in a series D.C. circuit to a reference potential to produce a preheating current only for a first predetermined time interval, said switch means including an output connected to said control input of said D.C.-A.C. converter and operable after a second predetermined time interval to produce a start pulse to cause operation of said D.C.-A.C. converter.

2. The ballast apparatus of claim 1, wherein said switch means comprises:

a timer connected to said output of said input means and operable in response to the D.C. operating voltage to provide a control signal for said first predetermined time interval; and a relay including a winding connected to said timer and relay contacts connected in D.C. series with said preheating resistor, said secondary winding of said at least one load transformer, the heater electrodes and the reference potential.

3. The ballast apparatus of claim 1, wherein said switch means comprises:

a start pulse generator connected to said control input of said D.C.-A.C. converter; and a timer connected to said output of said input means and connected to said start pulse generator, said timer operable after a second predetermined time interval and in response to the D.C. operating voltage to energize said start pulse generator.

4. The electronic ballast apparatus of claim 1, wherein said switch means comprises:

first and second timers, said first timer operable to time said first predetermined time interval and said second timer operable to time said second predetermined time interval, said second timer set to provide that said second predetermined interval is longer than said first predetermined interval to ensure reopening of said series D.C. circuit before operation of said D.C.-A.C. converter.

5. The electronic ballast apparatus of claim 1, wherein:

said D.C.-A.C. converter comprises a self-controlled switch bridge arrangement including bridge switches, a saturation transformer providing feedback to said bridge switches and an auxiliary winding, and means connected to said auxiliary winding and to said switch means and operable to effect short circuiting of said auxiliary winding during the second predetermined time interval.

6. The electronic ballast apparatus of claim 1, wherein:

said load transformer is a stray-field transformer; and an ignition capacitor is connected in parallel with the heater elements of said at least one fluorescent lamp and said secondary winding of said at least one load transformer and is effective with said secondary winding to form a series resonant circuit for promoting ignition of said fluorescent lamp, said series resonant circuit tuned approximately to the switching frequency of said D.C.-A.C. converter.

7. A fluorescent lamp system comprising:

a plurality of fluorescent lamps each including a pair of heater electrodes;

a plurality of load transformers each including a primary winding, and a secondary winding connected across said pair of heater electrodes of a respective fluorescent lamp;

a plurality of ignition capacitors connected in series and each connected in parallel across a respective secondary winding and the respective pair of heater electrodes;

a D.C.-A.C. converter including an input for receiving a D.C. operating voltage, a control input, and an output and operable to provide a high-frequency A.C. voltage at said output in response to a D.C. voltage at said input and the application of a start pulse at said control input;

input means including an input for connection to an A.C. voltage line, an output connected to said input of said D.C.-A.C. converter, and rectifier means connected between said input and said output for providing the D.C. operating voltage to said D.C.-A.C. converter;

a preheating resistor connected to said output of said input means; and switch means including a first switch connected between said preheating resistor and said plurality of serially-connected capacitors and a second switch connected between said plurality of serially-connected capacitors and a reference potential, and switch control means connected to said output of said input means and operated in response to the D.C. operating voltage to connect said preheating resistor, said pairs of heater electrodes and said secondary windings of said load transformers in a series D.C. circuit between said output of said input means and the reference potential to produce a preheating current only for a first predetermined time interval, said switch means further including an output connected to said control input of said D.C.-A.C. converter and operable after a second predetermined time interval to produce a start pulse to cause operation of said D.C.-A.C. converter.

* * * * *